US005435092A

United States Patent [19]

Brodie

[11] Patent Number: 5,435,092

[45] Date of Patent: Jul. 25, 1995

[54] CUSHION FOR USE WITH A FIREARM

[75] Inventor: Michael H. Brodie, Pardes Chanah, Israel

[73] Assignee: Flinch-Off Ltd., Petach Tikva, Israel

[21] Appl. No.: 287,739

[22] Filed: Aug. 9, 1994

[30] Foreign Application Priority Data

Feb. 7, 1994 [IL] Israel ..... 108,580

[51] Int. Cl.[6] ..... F41A 35/00; F41C 27/00

[52] U.S. Cl. ..... 42/104

[58] Field of Search ..... 42/104, 74, 71.02, 70.01, 42/106

[56] References Cited

U.S. PATENT DOCUMENTS

| | | | |
|---|---|---|---|
| 1,521,286 | 12/1924 | Fisher | 42/106 |
| 1,703,464 | 2/1929 | Wilshire | 42/104 |
| 3,031,786 | 5/1962 | Swan | 42/104 |
| 4,105,885 | 8/1978 | Orenstein | 42/70.01 |
| 4,206,563 | 6/1980 | Baldassarre et al. | 42/106 |

FOREIGN PATENT DOCUMENTS

| | | | |
|---|---|---|---|
| 650599 | 1/1929 | France | 42/104 |
| 14093 | 5/1896 | United Kingdom | 42/104 |

*Primary Examiner*—Charles T. Jordan

*Attorney, Agent, or Firm*—Robbins, Berliner & Carson

[57] ABSTRACT

A cushion for use in conjunction with a firearm trigger, the cushion being held between the trigger and the finger of the user, for masking the anticipated moment of firing from the user, thus eliminating possible flinching of the user during firing and thereby improving shooting accuracy.

9 Claims, 1 Drawing Sheet

CUSHION FOR USE WITH A FIREARM

The present invention relates to a cushion for use in contact with the trigger of a firearm.

More particularly, the invention is concerned with providing means for gradually applying pressure to the trigger while masking from the user the increasing resistance of the trigger mechanism before firing, thus eliminating the possibility that the user will flinch at the moment of firing and thereby improving shooting accuracy.

When a firearm must be used, either by an individual for self-defense or by security forces for stopping, wounding or killing an enemy, criminal or infiltrator, the accuracy of the firing can mean the difference between survival and becoming a casualty, while failure to apprehend such a person may cause further bloodshed. Conversely, there are circumstances, such as the apprehension of a person not heeding a warning or warnings to stop for identification, when it is important to shoot to arrest—usually at the leg of a fleeing person or at the tires of a moving vehicle—and in such a case, a shot causing major injury or death can have tragic consequences. In other circumstances, accuracy of firing may be essential to prevent injury to bystanders.

Needless to say, in target shooting and competition, accuracy is the prime consideration.

A prerequisite for achieving the needed accuracy in shooting is that the weapon used be held steady and aimed at the moment of firing. Much attention has been given to the mechanics of aiming and to improvements in the accuracy of the firearm itself. However, extensive experience on target shooting ranges has shown that many people who correctly aim their weapons will then react to the increasing resistance of the trigger mechanism, which is felt by the trigger finger just before firing. A subconscious mental message, based on previous experience, is then conveyed to the brain of the user, who is then likely to flinch in anticipation of the retort and recoil of the firearm, resulting in loss of aim.

It is therefore the object of the present invention to obviate the disadvantages of the prior art firing arrangements, and to provide means for masking from the user the anticipated moment of firing, so as to avoid flinching and retain correct aim during the moment of firing.

The present invention achieves the above objective by providing a cushion for use in conjunction with a firearm trigger, said cushion being held between said trigger and the finger of the user, for masking the anticipated moment of firing from the user, thus eliminating possible flinching of the user during firing and thereby improving shooting accuracy.

In a further embodiment of the present invention, there is provided a firearm wherein the trigger is provided with an attached cushion positioned on the surface thereof which contacts the finger of the user for masking the moment of firing from the user, thus eliminating possible flinching of the user during firing.

In a most preferred embodiment of the present invention, there is provided a glove for use in the operation of a firearm, wherein the portion of the glove which covers the user's trigger finger is provided with an attached cushion positioned on the surface thereof which contacts the trigger, for masking the moment of firing from the user and thus eliminating possible flinching of the user during firing.

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

Figure 1:
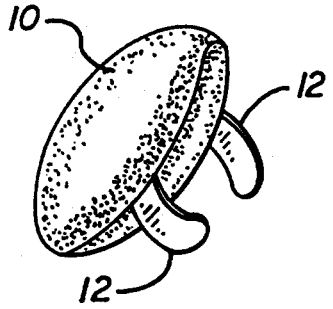
FIG. 1 is a perspective view of an embodiment of the cushion according to the present invention for attachment to a trigger of a firearm.

There is seen in FIG. 1 a cushion 10 for use in conjunction with the trigger of a firearm. During firing, cushion 10 is held between the trigger of the firearm and the finger of the user. Thereby, the anticipated moment of firing is masked from the user and thus eliminates possible flinching of the user during firing.

In the preferred embodiment shown, cushion 10 is provided with an attachment member 12, shown in the form of a spring-steel clip, for holding the cushion 10 on the trigger. The user can carry the cushion 10 with him and temporarily attach it to any firearm which he uses. When the firearm is to be given up, for example, at the end of a term of army or civil guard service, the user retains the cushion in his possession.

The cushion 10 may be constructed from any of a wide array of materials, such as solid rubber, sponge rubber, foamed plastics, a metal or plastic spring, or a gel. A cushion suitable for use in conjunction with a light firearm has a Shore A hardness in the range of 3 to 30. Such a cushion is suitably made of a foamed rubber. A cushion for use with a heavy firearm, such as a half-inch caliber machine gun, has a Shore A hardness lying in the range of 20 to 50. Such a cushion is suitably made of a substance based on silicone, for example, a silicone rubber such as polysiloxane.

Figure 2:
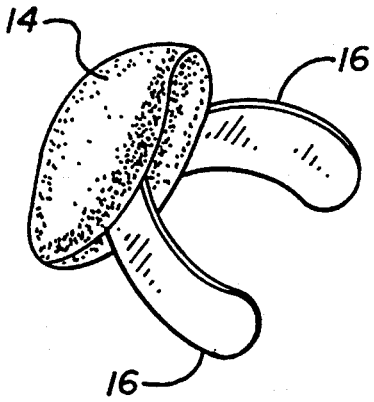
FIG. 2 is a perspective view of an embodiment of the cushion for attachment to the finger of the user.

Referring now to FIG. 2, there is seen a cushion 14 provided with an attachment member 16 for holding the cushion 14 to a finger of the user. Such an arrangement is particularly convenient when a plurality of prior art weapons are to be fired sequentially. Member 16 comprises a spring clip made of a material such as spring steel or nylon, having an internal diameter of between 1 and 2 cm.

It is to be noted that the embodiments of FIGS. 1 and 2 are suitable for use in conjunction with prior art firearms.

Figure 5:
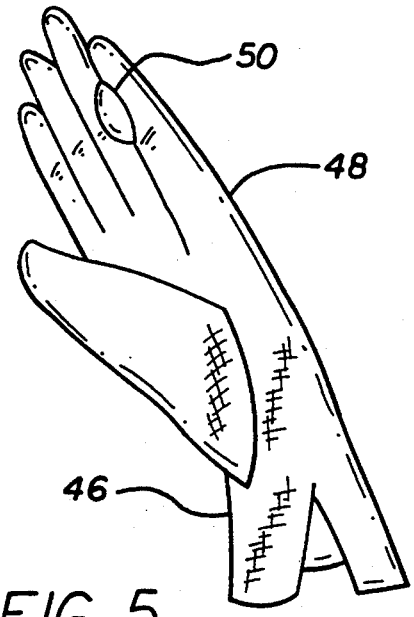
FIG. 5 is a perspective view of a glove provided with a cushion according to the invention.

It is also to be noted that cushion 14 can be attached to the finger of the user by other means (not shown), such as by being embodied in a sheath which goes over the trigger finger, or in a glove as shown in FIG. 5.

Figure 3:
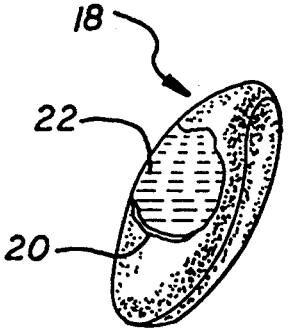
FIG. 3 is a fragmented, perspective view of a two-component cushion.

FIG. 3 shows a cushion 18, composed of an outer flexible membrane 20 containing a filling 22. Membrane 20 is made of a wear-resistant but flexible material, such as butyl rubber, which material is substantially impermeable to gases. The filling 22 is a compressible material of any type. For example, the filling 22 may be a gas such as air, or advantageously a compound gas composed of large-size molecules, such a gas being more securely retained without leakage.

Filling 22 may also be a liquid, such as water. In such an embodiment, the required cushion compressibility is achieved by the use of a stretchable rubber membrane enclosing the liquid. As is known, liquids are almost completely incompressible, but due to their larger molecular size, they are easier to retain in a flexible enclosure than are gases.

Figure 4:
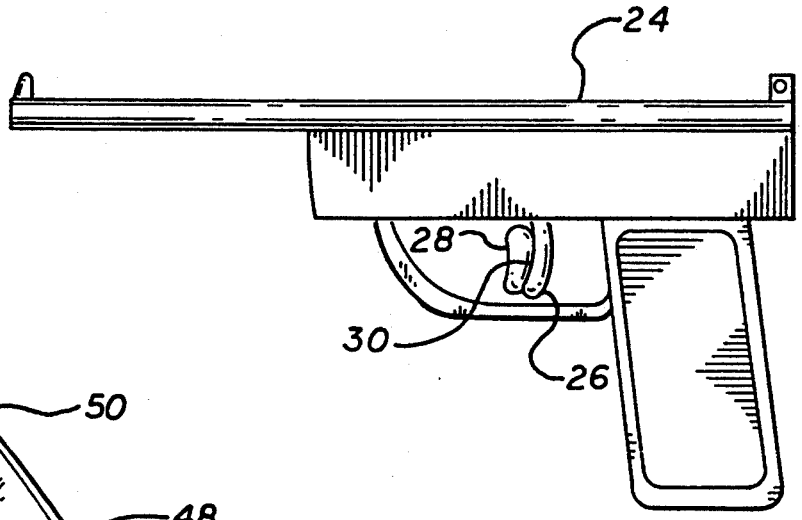
FIG. 4 is a front elevational view of a firearm provided with an externally-attached cushion.

FIG. 4 depicts a firearm 24 wherein the trigger 26 is provided with an attached cushion 28, positioned on that portion of the trigger surface 30 which would normally contact the finger of the user. Cushion 28 is advantageously attached to the trigger in a permanent manner, for example, by molding, adhesion, rivetting or tight insertion in a suitable recess. The cushion 28 thus becomes an integral part of the firearm 24, and will be used whenever said firearm is operated.

FIG. 5 shows a glove 46 for use in the operation of a firearm. The portion of the glove 48 which covers the index finger of the user is provided with an attached cushion 50, positioned on the surface which will contact the trigger of a firearm when the glove is in use. Glove 46 is particularly useful when a plurality of prior art weapons are to be operated. It is also advantageous in cold climates, where gloves are required for the purpose of protecting the hands from high heat losses.

It will be evident to those skilled in the art that the invention is not limited to the details of the foregoing illustrated embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A cushion in conjunction with a firearm trigger, said cushion being held adjacent a front surface of said trigger between said trigger and a trigger-pulling finger of a user of said firearm and constructed of material having a hardness which would mask the anticipated moment of discharge from the user during depression of the trigger to discharge the firearm, thus eliminating possible flinching of the user during the discharge of said firearm and thereby improving shooting accuracy.

2. A cushion as claimed in claim 1, further comprising an attachment member for holding said cushion to the trigger of a firearm.

3. A cushion as claimed in claim 1, wherein said cushion is filled with a silicone-based substance.

4. A cushion as claimed in claim 1, wherein said cushion is composed of an outer flexible membrane containing a filling.

5. A cushion as claimed in claim 1, having a Shore hardness in the range of between 3 to 30, for use in conjunction with a light firearm.

6. A firearm having a firing trigger which is depressed to discharge said firearm, wherein said trigger is provided with an attached cushion positioned on a front surface of said trigger between said trigger and a trigger-pulling finger of a user of said firearm and constructed of material having a hardness which would mask the anticipated moment of discharge from the user during depression of the trigger to discharge the firearm, and thus eliminating possible flinching of the user during the discharge of said firearm and thereby improving shooting accuracy.

7. A firearm as claimed in claim 6, wherein said cushion has a shore hardness in the range of between about 3 and 30.

8. A glove for use in the operation of a firearm having a firing trigger which is depressed to discharge said firearm, wherein the portion of the glove which covers a user's trigger finger is provided with an attached cushion positioned on the surface thereof which contacts a front surface of said trigger and constructed of material having a hardness which would mask the anticipated moment of discharge from the user during depression of the trigger to discharge the firearm, and thus eliminating possible flinching of the user during the discharge of said firearm and thereby improving shooting accuracy.

9. A glove as claimed in claim 8, wherein said cushion has a shore hardness in the range of between about 3 and 30.

* * * * *